US010888901B2

(12) United States Patent
Ward

(10) Patent No.: US 10,888,901 B2
(45) Date of Patent: Jan. 12, 2021

(54) SORTING OR CLASSIFYING MACHINES

(71) Applicant: BÜHLER UK LIMITED, London (GB)

(72) Inventor: Liam Ward, London (GB)

(73) Assignee: BÜHLER UK LIMITED, London (GB)

( * ) Notice: Subject to any disclaimer, the term of this patent is extended or adjusted under 35 U.S.C. 154(b) by 196 days.

(21) Appl. No.: 16/313,596

(22) PCT Filed: Jun. 28, 2017

(86) PCT No.: PCT/EP2017/066075
§ 371 (c)(1),
(2) Date: Dec. 27, 2018

(87) PCT Pub. No.: WO2018/002190
PCT Pub. Date: Jan. 4, 2018

(65) Prior Publication Data

US 2019/0314862 A1 Oct. 17, 2019

(30) Foreign Application Priority Data

Jun. 28, 2016 (EP) ..... 16176664

(51) Int. Cl.
*B07C 5/342* (2006.01)

(52) U.S. Cl.
CPC ..... *B07C 5/342* (2013.01); *B07C 2501/0081* (2013.01)

(58) Field of Classification Search
CPC ..... B07C 5/342; B07C 5/3412; B07C 2501/0081
USPC ..... 209/577
See application file for complete search history.

(56) References Cited

U.S. PATENT DOCUMENTS

2008/0078707 A1 4/2008 Wattawa
2014/0305851 A1* 10/2014 Hubbell ..... B07C 5/3412 209/583

FOREIGN PATENT DOCUMENTS

EP 0 325 558 A1 7/1989

OTHER PUBLICATIONS

International Search Report and Written Opinion for corresponding Patent Application No. PCT/EP2017/066075 dated Sep. 8, 2017.

* cited by examiner

*Primary Examiner* — Terrell H Matthews
(74) *Attorney, Agent, or Firm* — Renner, Otto, Boisselle & Sklar, LLP

(57) ABSTRACT

An optical sorting or classifying machine for sorting or classifying product, comprising a housing (3) which includes an internal region (19), a chute (5) which has a guide surface (29) and is supported by the housing (3), an illumination unit (7*a-d*) for illuminating product as delivered on and/or from the chute (5), and at least one detector (9*a, b*) for detecting product as delivered on and/or from the chute (5); characterized in that the chute (5) is pivotably coupled to the housing (3) about a first pivot (31) between a first, operative configuration, in which the chute (19) extends across the internal region (19) and prevents access or entry into the internal region (19) by an operator, and a second, stowed configuration, in which an operator can access or enter the internal region (19).

15 Claims, 9 Drawing Sheets

SORTING OR CLASSIFYING MACHINES

The present invention relates to sorting or classifying machines, in particular optical sorting or classifying machines for sorting or classifying product, and in particular flows of particulate product, and especially foodstuffs and vegetables.

In one aspect the present invention provides an optical sorting or classifying machine for sorting or classifying product, comprising a housing which includes an internal region, a chute which has a guide surface and is supported by the housing, an illumination unit for illuminating product as delivered on and/or from the chute, and at least one detector for detecting product as delivered on and/or from the chute; characterized in that the chute is pivotably coupled to the housing about a first pivot between a first, operative configuration, in which the chute extends across the internal region and prevents access or entry into the internal region by an operator, and a second, stowed configuration, in which an operator can access or enter the internal region.

In one embodiment the chute is disposed adjacent or at least partially within a wall of the housing.

In one embodiment the wall is an upper wall.

In one embodiment the housing comprises a plurality of walls which enclose the internal region.

In one embodiment the housing comprises a frame structure and one or more panels which are attached to the frame structure so as at least partially to enclose the housing, optionally the housing comprises at least one roof panel.

In one embodiment the first axis comprises an axle which is supported by mounting cradles.

In one embodiment the chute is pivotally coupled to the first pivot proximal a first edge of the chute, such that a major portion of the guide surface is disposed to one side of the first pivot, and a second, distal edge of the chute depends in downward relation to the first edge when the chute is in the operative position.

In one embodiment the housing includes at least one engagement member, and the chute includes at least one engagement member, which is counterpart to the at least one engagement member on the housing, and the engagement members are configured to engage one another when the chute is in the operative position and define a fixed, operative position for the second edge of the chute.

In one embodiment the chute includes a counterbalance which is disposed to the opposite side of the first pivot to the major portion of the guide surface, and acts to bias the chute so as to maintain the chute in the stowed position when the chute is moved from the operative position.

In one embodiment the chute comprises a first member which is pivotally coupled to the first pivot, and a second member which supports the guide surface and is pivotally coupled to the first member about a second pivot, which is distal to the first pivot, between an operative, expanded position and a collapsed position.

In one embodiment the second member is nested within the first member when in the collapsed configuration.

In one embodiment the chute further comprises a positioner by which the position of second member is adjustable between the operative and collapsed positions.

In one embodiment the positioner comprises a cam member and an actuator, which is operated to move the cam member between the expanded and collapsed positions.

In another aspect the present invention provides an optical sorting or classifying machine for sorting or classifying product, comprising a housing which includes an internal region, a chute which has a guide surface and is supported by the housing, an illumination unit for illuminating product as delivered on and/or from the chute, and at least one detector for detecting product as delivered on and/or from the chute; characterized in that the chute is pivotably coupled to the housing about a first pivot between a first, operative configuration, and a second, stowed configuration, in which an operator can access or enter the internal region.

In a further aspect the present invention provides an optical sorting or classifying machine for sorting or classifying product, comprising a housing, and a chute which has a guide surface and is supported by the housing, an illumination unit for illuminating product as delivered on and/or from the chute, and at least one detector for detecting product as delivered on and/or from the chute; characterized in that the chute comprises a first member which is pivotally coupled to the housing about a first pivot, and a second member which supports the guide surface and is pivotally coupled to the first member about a second pivot between an operative, expanded position and a collapsed position.

Preferred embodiments of the present invention will now be described hereinbelow by way of example only with reference to the accompanying drawings, in which.

Figure 1:
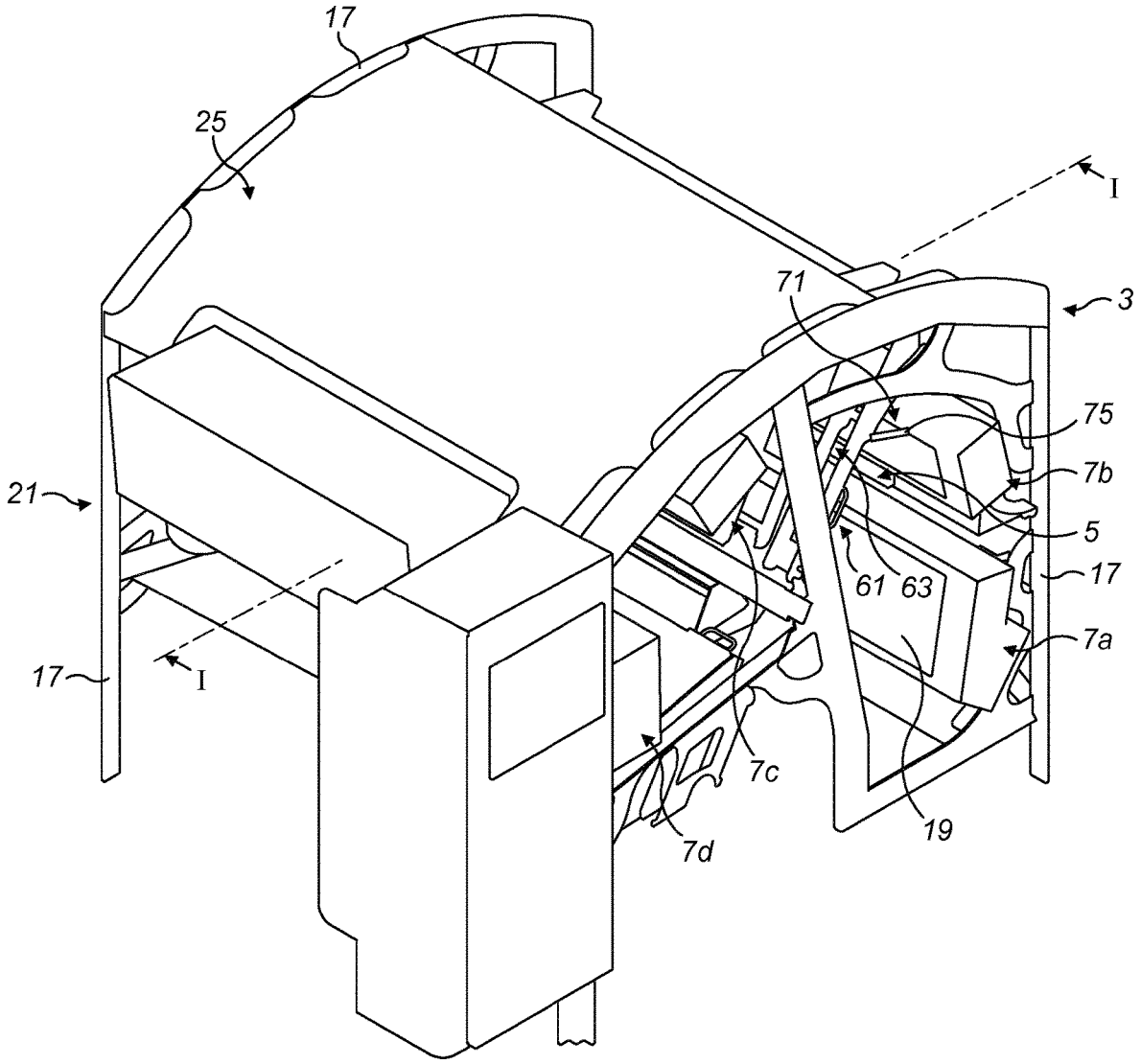
FIG. 1 illustrates a perspective view of a sorting or classifying machine in accordance with one embodiment of the present invention.
Figure 2:
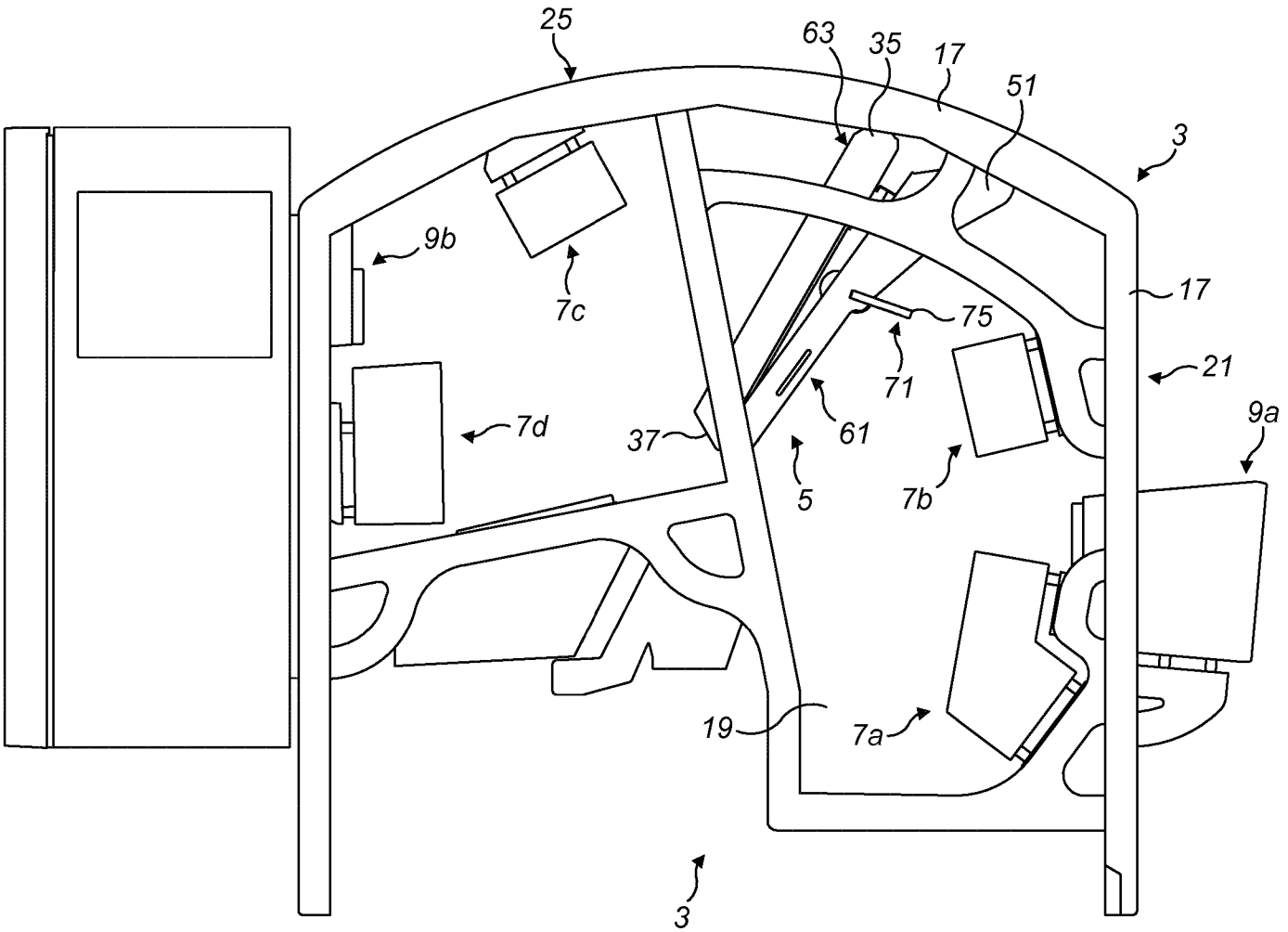
FIG. 2 illustrates a side view of the sorting or classifying machine of FIG. 1.
Figure 3:
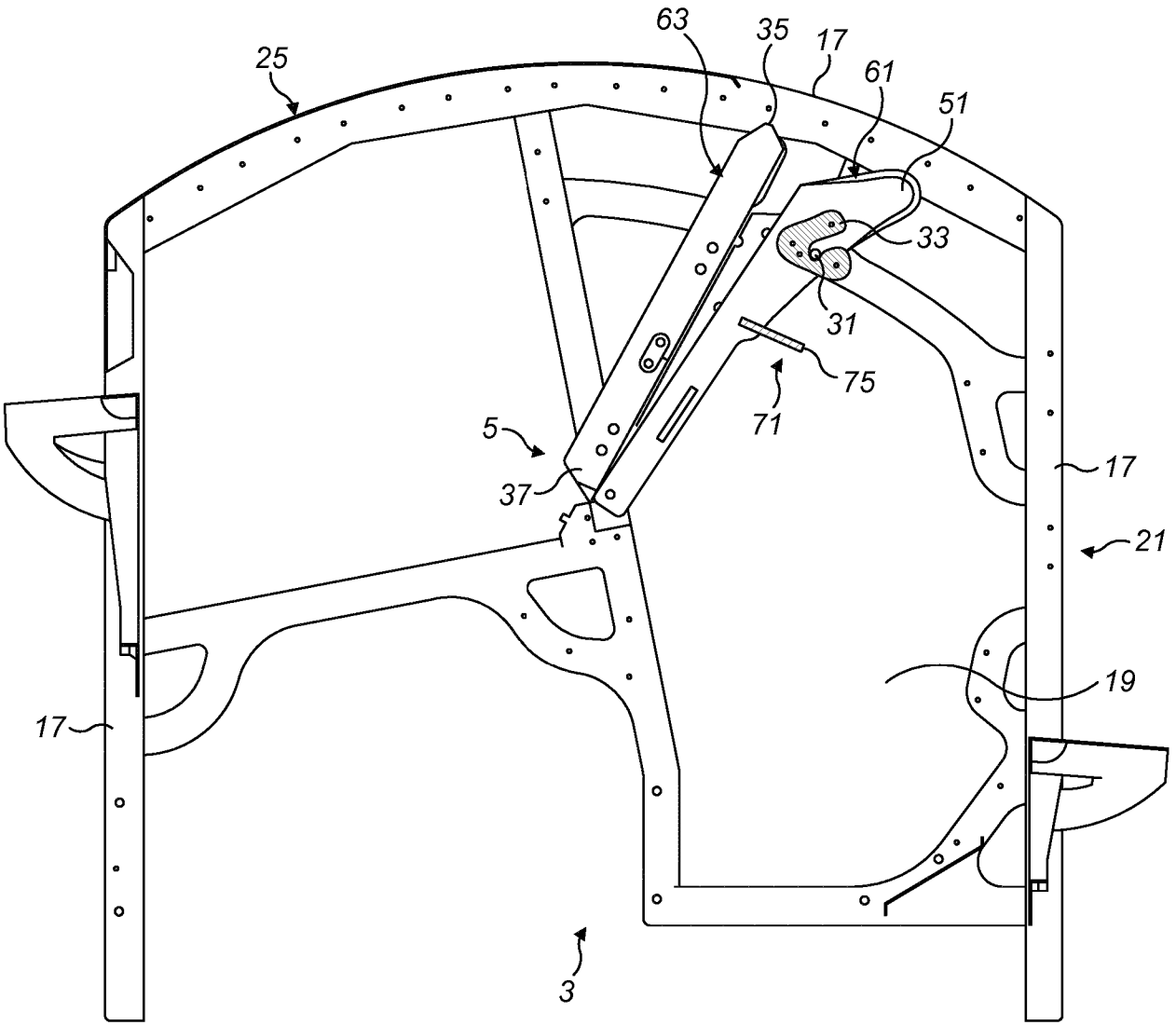
FIG. 3 illustrates a vertical sectional view (along section I-I of FIG. 1) of the sorting or classifying machine of FIG. 1.

FIGS. 6(*a*) to (*d*) illustrate the steps in collapsing the second chute part in relation to the first chute part of the sorting or classifying machine of FIG. 1; and FIGS. 7(*a*) to (*d*) illustrate the steps in stowing the chute of the sorting or classifying machine of FIG. 1.

The sorting or classifying machine comprises a housing 3, a chute 5 which is supported by the housing 3 and to which a flow of particulate product is delivered, typically from an infeed vibrator, at least one illumination unit 7*a-d* for illuminating product as delivered on and/or from the chute 5, and at least one detector 9*a, b* for detecting product as delivered on and/or from the chute 5.

In this embodiment the housing 3 comprises a plurality of walls 17 which enclose an internal region 19.

In this embodiment the housing 3 comprises side, end and upper walls 17.

In this embodiment the housing 3 comprises a frame structure 21 and one or more panels 25, here at least one roof panel, which is attached to the frame structure 21, so as at least partially to enclose the housing 3.

Figure 4:
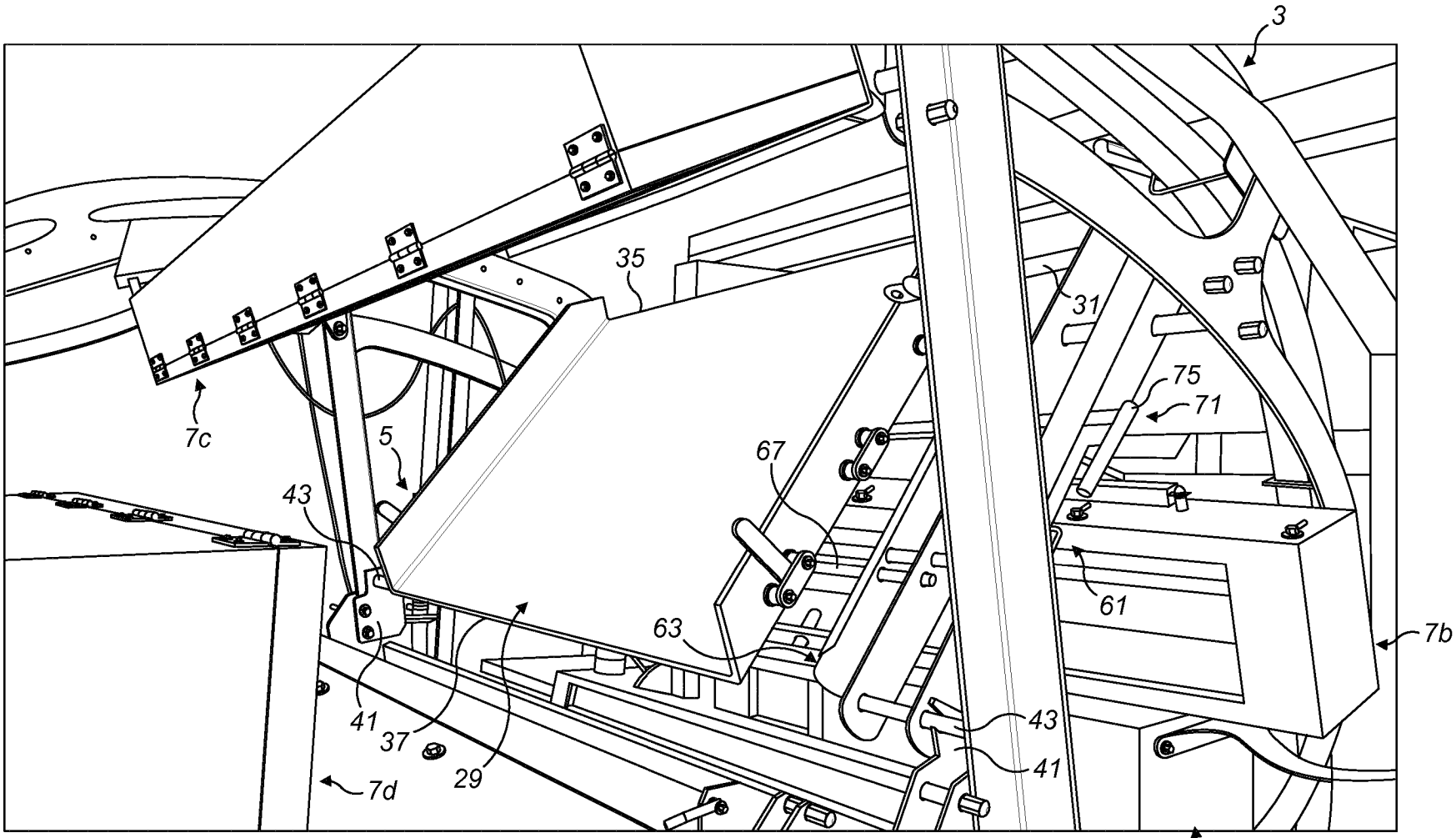
FIG. 4 illustrates a fragmentary perspective view of the sorting or classifying machine of FIG. 1, with the chute in the operative configuration.
Figure 5:
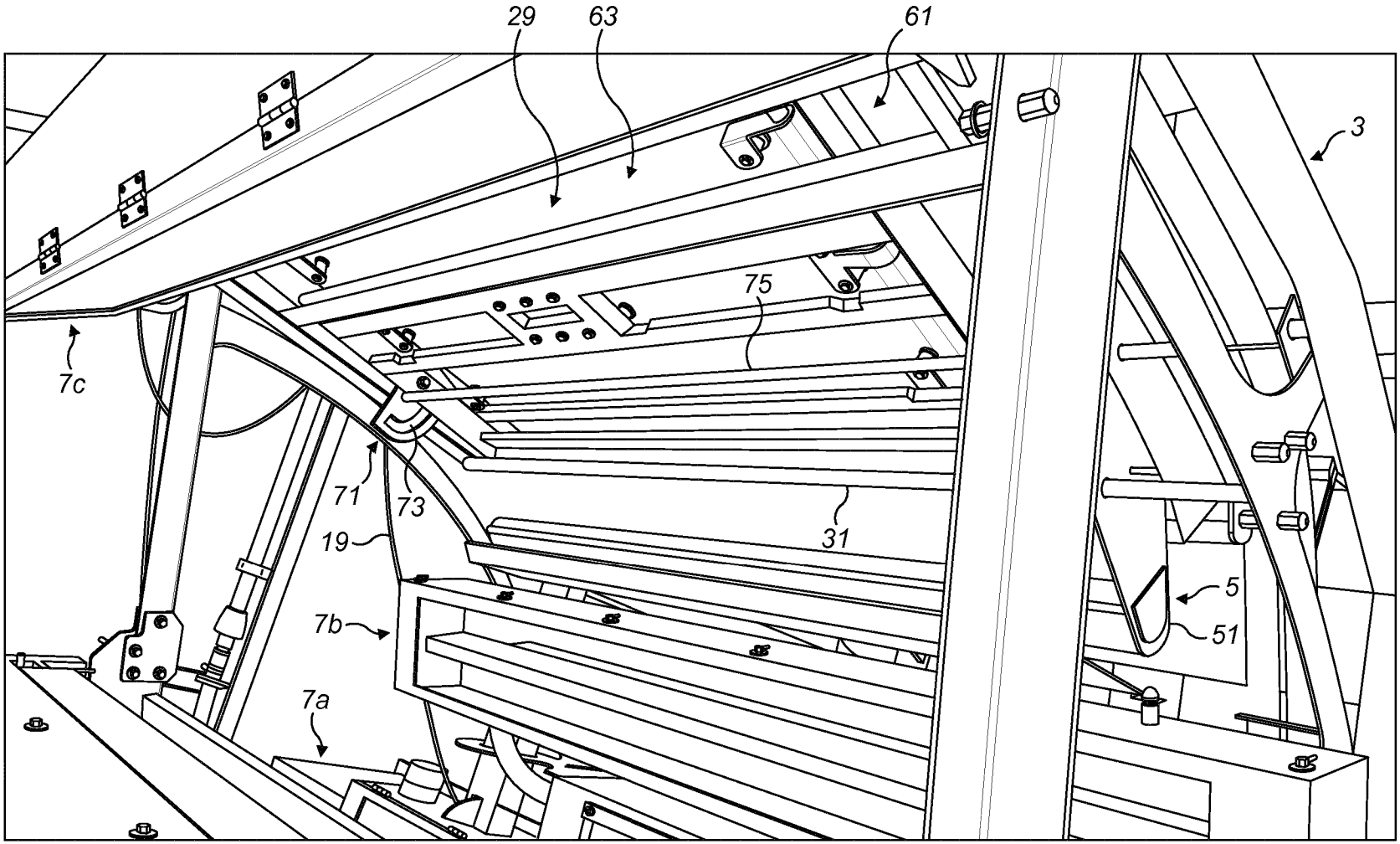
FIG. 5 illustrates a fragmentary perspective view of the of the sorting or classifying machine of FIG. 1, with the chute in the stowed configuration.
Figure 6A:
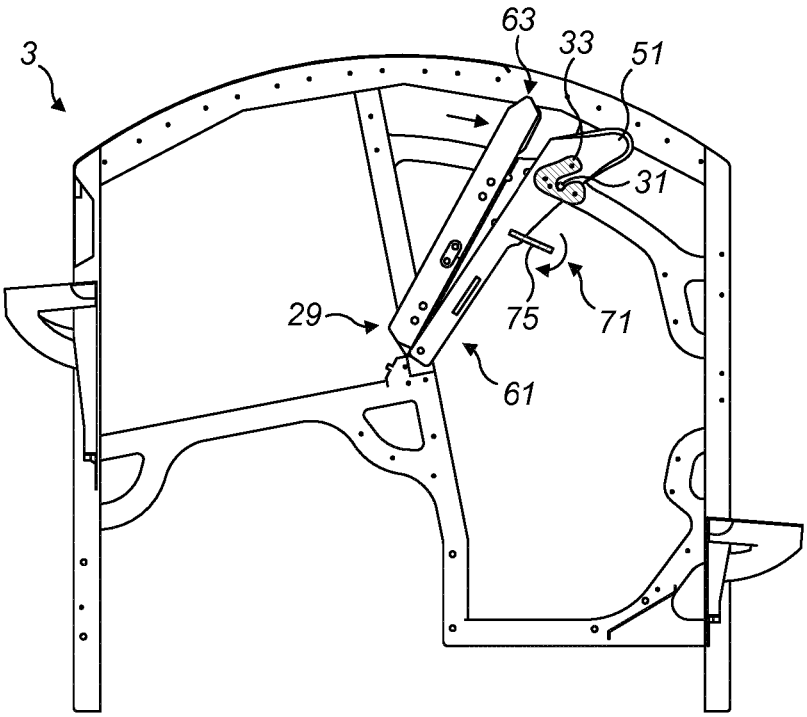
Figure 6B:
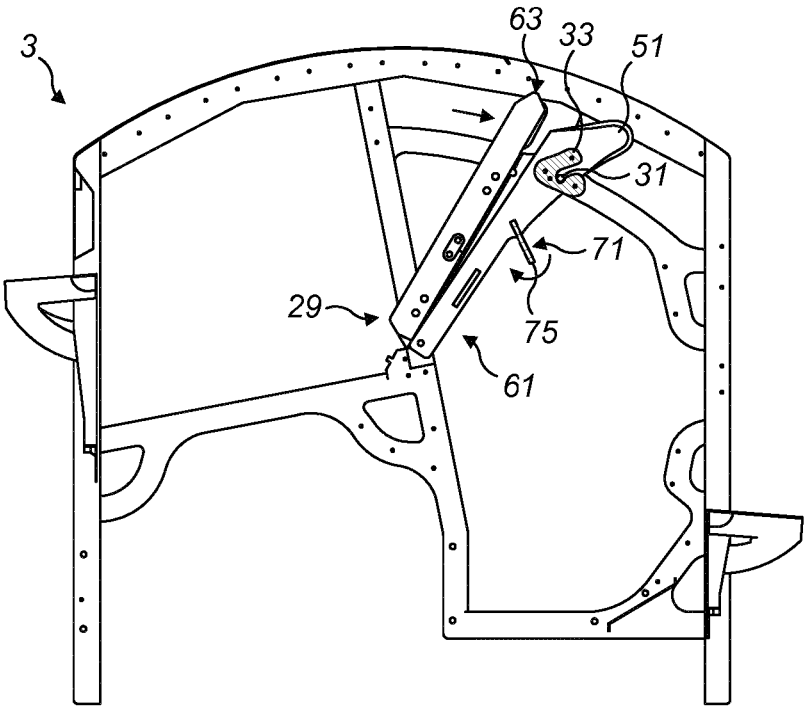
Figure 6C:
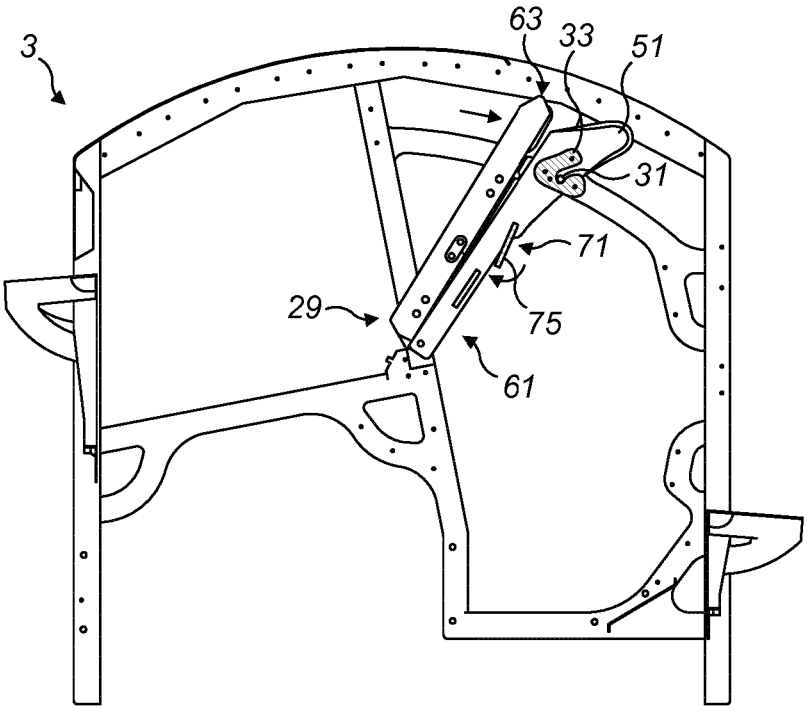
Figure 6D:
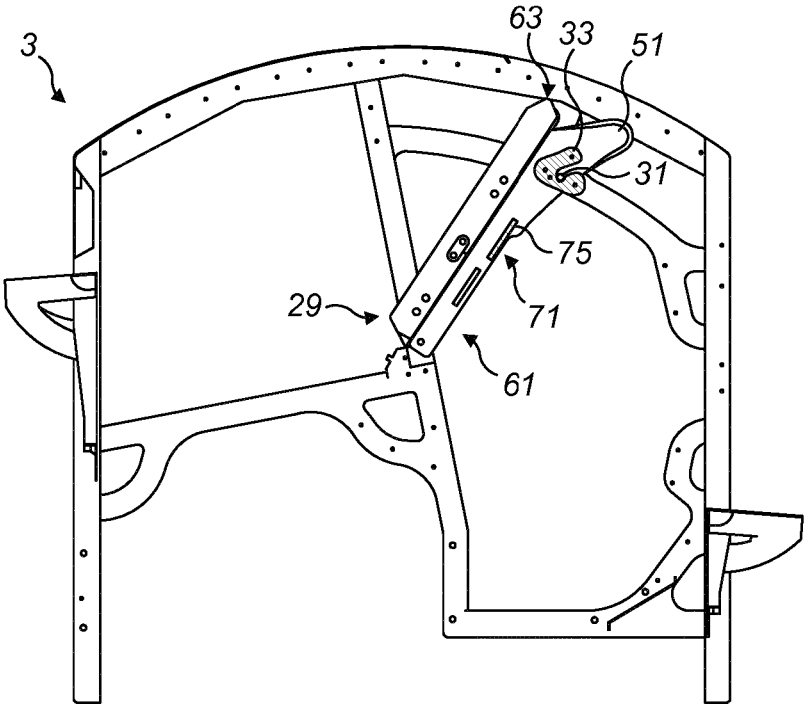
Figure 7A:
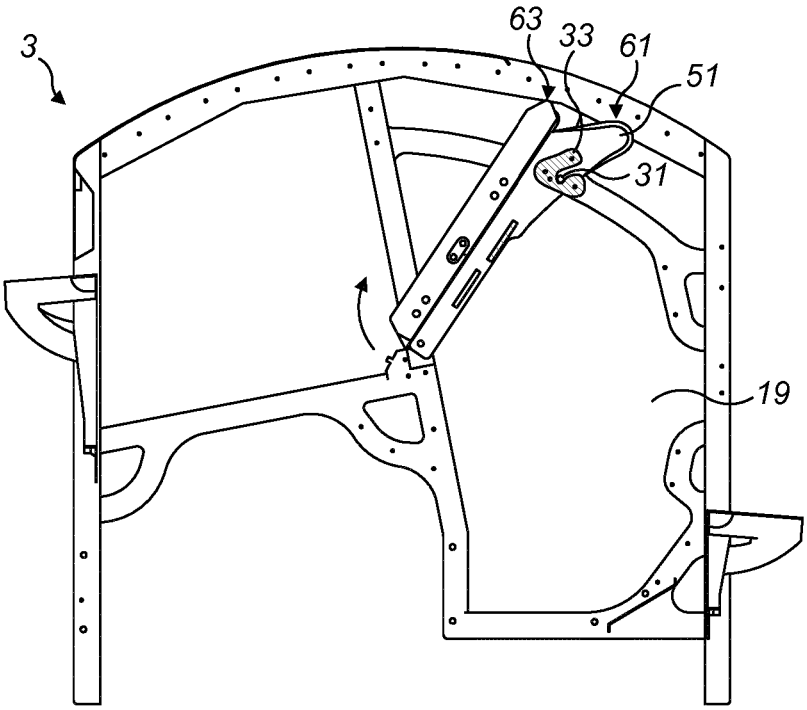
Figure 7B:
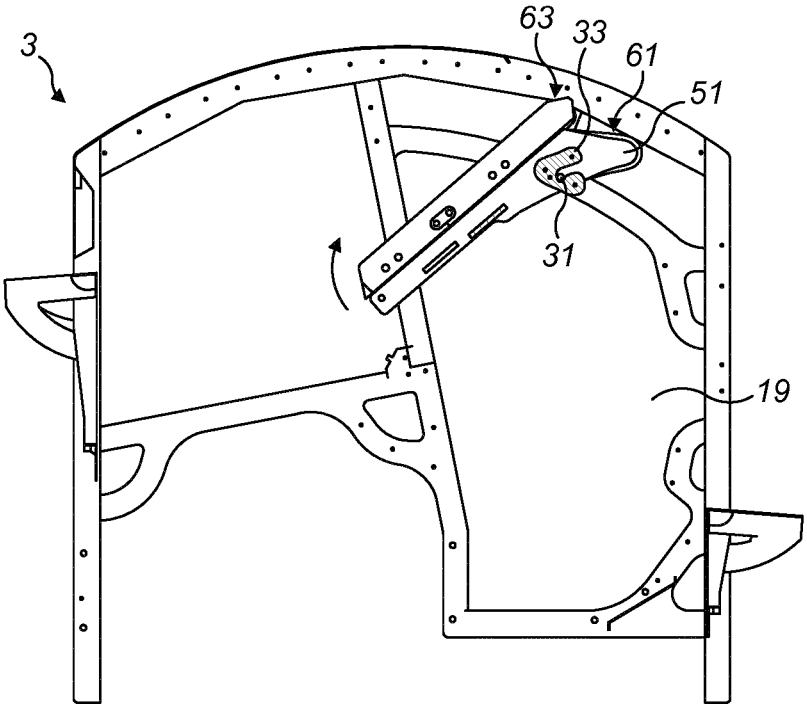
Figure 7C:
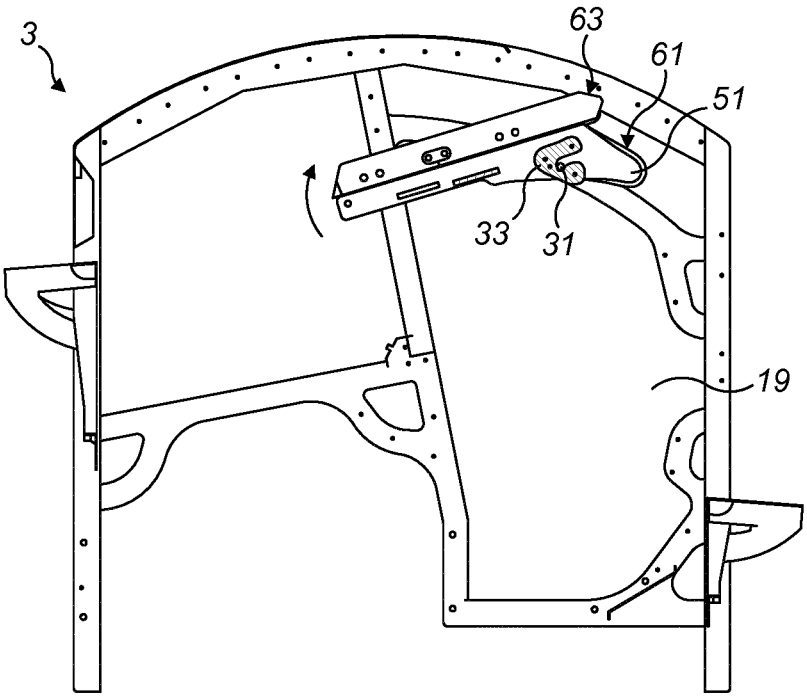
Figure 7D:
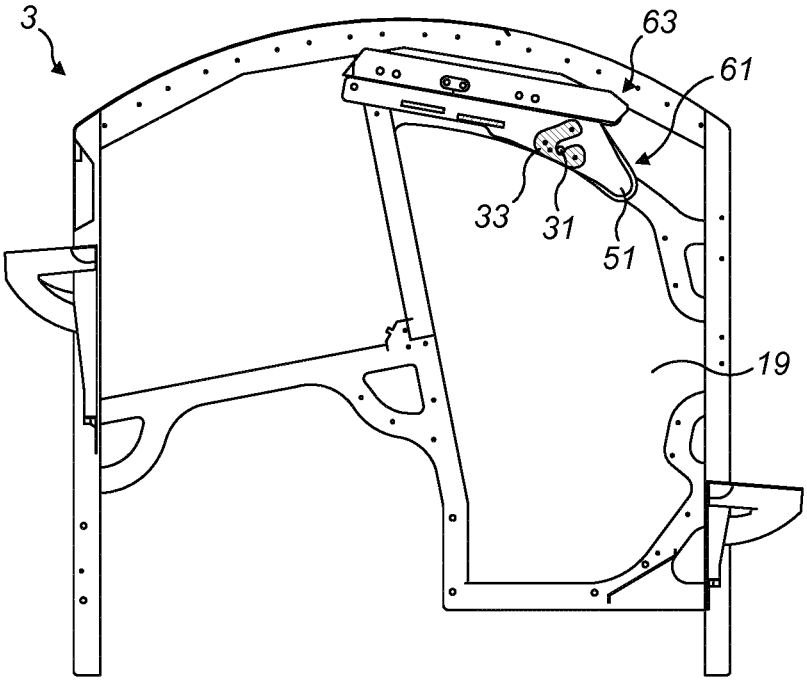

In this embodiment the chute 5 comprises a guide surface 29 over which particulate product in use flows, and is pivotably coupled to the housing 3 about a first pivot 31, here provided by an axle, between a first, lowered, operative position (as illustrated in FIG. 4), in which the guide surface 29 of the chute 5 is inclined downwardly and guides particulate product, and a second, stowed position (as illustrated in FIG. 5), in which the chute 5 is disposed adjacent or at least partially within at least one of the walls 17 of the housing 3, here the upper wall 17.

In this embodiment the first pivot 31 is supported at the respective ends by mounting cradles 33.

By providing for stowing of the chute 5, the present inventor has devised a configuration which advantageously allows for an operator more readily to access the internal region 19 of the housing 3, such as for cleaning or maintenance.

In this embodiment the chute 5 is pivotally coupled to the first pivot 31 proximal a first, upper edge 35 of the chute 5, such that a major portion of the guide surface 29 is disposed to one side of the first pivot 31, and a second, distal edge 37 of the chute 5 depends in downward relation to the first edge 35 when the chute 5 is in the operative position.

In one embodiment the housing 3 includes at least one engagement member 41, here a recess, and the chute 5 includes at least one engagement member 43, here a lug, which is counterpart to the at least one engagement member 41 on the housing 3, and the engagement members 41, 43 are configured to engage one another when the chute 5 is in the operative position and define a fixed, operative position for the second edge 37 of the chute 5.

In this embodiment the housing 3 includes first and second engagement members 41, and the chute 5 includes first and second counterpart engagement members 43 in which respective ones of the first and second engagement members 41 of the housing 3 are located.

In this embodiment the chute 5 includes a counterbalance 51 which is disposed to the opposite side of the pivot 31 to the major portion of the guide surface 29 of the chute 5, and acts to bias the chute 5 so as to maintain the chute 5 in the stowed position when the chute 5 is moved from the operative position.

In one alternative embodiment the counterbalance 51 could be replaced by an actuator, such as a pneumatic actuator, which is actuatable to move the chute 5 between the operative and stowed positions.

In this embodiment the chute 5 comprises a first member 61 which is pivotally coupled to the first pivot 31, a second member 63 which supports the guide surface 29 and is pivotally coupled to the first member 61 about a second pivot 67, which is distal to the first pivot 31, here towards the second edge 37 of the chute 5, between an operative, expanded position (as illustrated in FIG. 6(*a*)) and a collapsed position (as illustrated in FIG. 6(*d*)), and a positioner 71 by which the position of second member 63 is adjustable between the operative and collapsed positions.

In this embodiment the second member 63 is nested inwardly within the first member 61 when in the collapsed configuration.

In this embodiment the positioner 71 comprises a cam member 73 and an actuator 75, here a handle, which is operated to move the cam member 73 between the expanded and collapsed positions.

With this configuration, the chute 5 can be configured to have an expanded configuration for the guide surface 29 to receive particulate product, and allows for the chute 5 to be collapsed so as to adopt a smaller, compact configuration, which allows for the chute 5 to stowed adjacent the wall 17 of the housing 3 without requiring complicated articulation of the chute 5 to avoid collision with other component parts, such as the infeed vibrator.

FIGS. 6(*a*) to (*d*) and 7(*a*) to (*d*) illustrate, respectively, the steps in collapsing the chute members 61, 63, and stowing the collapsed chute 5 adjacent the upper wall 17 of the housing 3, with the counterbalance 51 maintaining the chute 5 in the stowed position.

Finally, it will be understood that the present invention has been described in its preferred embodiments and can be modified in many different ways without departing from the scope of the invention as defined by the appended claims.

Various further aspects of the invention are identified in the numbered paragraphs below.

1. A sorting or classifying machine for sorting or classifying product, comprising a housing (3) which includes an internal region (19), and a chute (5) which has a guide surface (29) and is supported by the housing (3); characterized in that the chute (5) is pivotably coupled to the housing (3) about a first pivot (31) between a first, operative configuration, in which the chute (19) extends across the internal region (19) and prevents access or entry into the internal region (19) by an operator, and a second, stowed configuration, in which an operator can access or enter the internal region (19).
2. The machine of paragraph 1, wherein the chute (5) is disposed adjacent or at least partially within a wall of the housing (3).
3. The machine of paragraph 2, wherein the wall (17) is an upper wall (17).
4. The machine of any of paragraphs 1 to 3, wherein the housing (3) comprises a plurality of walls (17) which enclose the internal region (19).
5. The machine of any of paragraphs 1 to 4, wherein the housing (3) comprises a frame structure (21) and one or more panels (25) which are attached to the frame structure (21) so as at least partially to enclose the housing (3), optionally the housing (3) comprises at least one roof panel (25).
6. The machine of any of paragraphs 1 to 5, wherein the first axis (31) comprises an axle which is supported by mounting cradles (33).
7. The machine of any of paragraphs 1 to 6, wherein the chute (5) is pivotally coupled to the first pivot (31) proximal a first edge (35) of the chute (5), such that a major portion of the guide surface (29) is disposed to one side of the first pivot (31), and a second, distal edge (37) of the chute (5) depends in downward relation to the first edge (35) when the chute (5) is in the operative position.
8. The machine of paragraph 7, wherein the housing (3) includes at least one engagement member (41), and the chute (5) includes at least one engagement member (43), which is counterpart to the at least one engagement member (41) on the housing (3), and the engagement members (41, 43) are configured to engage one another when the chute (5) is in the operative position and define a fixed, operative position for the second edge (37) of the chute (5).
9. The machine of paragraph 7 or 8, wherein the chute (5) includes a counterbalance (51) which is disposed to the opposite side of the first pivot (31) to the major portion of the guide surface (29), and acts to bias the chute (5) so as to maintain the chute (5) in the stowed position when the chute (5) is moved from the operative position.
10. The machine of any of paragraphs 7 to 9, wherein the chute (5) comprises a first member (61) which is pivotally coupled to the first pivot (31), and a second member (63) which supports the guide surface (29) and is pivotally coupled to the first member (61) about a second pivot (67), which is distal to the first pivot (31), between an operative, expanded position and a collapsed position.
11. The machine of paragraph 10, wherein the second member (63) is nested within the first member (61) when in the collapsed configuration.

12. The machine of paragraph 10 or 11, wherein the chute (5) further comprises a positioner (71) by which the position of second member (63) is adjustable between the operative and collapsed positions.

13. The machine of paragraph 12, wherein the positioner (71) comprises a cam member (73) and an actuator 75, which is operated to move the cam member (73) between the expanded and collapsed positions.

14. A sorting or classifying machine for sorting or classifying product, comprising a housing (3) which includes an internal region (19), and a chute (5) which has a guide surface (29) and is supported by the housing (3); characterized in that the chute (5) is pivotably coupled to the housing (3) about a first pivot (31) between a first, operative configuration, and a second, stowed configuration, in which an operator can access or enter the internal region (19).

15. A sorting or classifying machine for sorting or classifying product, comprising a housing (3), and a chute (5) which has a guide surface (29) and is supported by the housing (3); characterized in that the chute (5) comprises a first member (61) which is pivotally coupled to the housing (3) about a first pivot (31), and a second member (63) which supports the guide surface (29) and is pivotally coupled to the first member (61) about a second pivot (67) between an operative, expanded position and a collapsed position.

The invention claimed is:

1. An optical sorting or classifying machine for sorting or classifying product, comprising a housing which includes an internal region, a chute which has a guide surface and is supported by the housing, an illumination unit for illuminating product as delivered on and/or from the chute, and at least one detector for detecting product as delivered on and/or from the chute; wherein the chute is pivotably coupled to the housing about a first pivot between a first, operative configuration, in which the chute extends across the internal region and prevents access or entry into the internal region by an operator, and a second, stowed configuration, in which an operator can access or enter the internal region.

2. The machine of claim 1, wherein the chute is disposed adjacent or at least partially within a wall of the housing.

3. The machine of claim 2, wherein the wall is an upper wall.

4. The machine of claim 1, wherein the housing comprises a plurality of walls which enclose the internal region.

5. The machine of claim 1, wherein the housing comprises a frame structure and one or more panels which are attached to the frame structure so as at least partially to enclose the housing, optionally the housing comprises at least one roof panel.

6. The machine of claim 1, wherein the first axis comprises an axle which is supported by mounting cradles.

7. The machine of claim 1, wherein the chute is pivotally coupled to the first pivot proximal a first edge of the chute, such that a major portion of the guide surface is disposed to one side of the first pivot, and a second, distal edge of the chute depends in downward relation to the first edge when the chute is in the operative position.

8. The machine of claim 7, wherein the housing includes at least one engagement member, and the chute includes at least one engagement member, which is counterpart to the at least one engagement member on the housing, and the engagement members are configured to engage one another when the chute is in the operative position and define a fixed, operative position for the second edge of the chute.

9. The machine of claim 7, wherein the chute includes a counterbalance which is disposed to the opposite side of the first pivot to the major portion of the guide surface, and acts to bias the chute so as to maintain the chute in the stowed position when the chute is moved from the operative position.

10. The machine of claim 7, wherein the chute comprises a first member which is pivotally coupled to the first pivot and a second member which supports the guide surface and is pivotally coupled to the first member about a second pivot, which is distal to the first pivot, between an operative, expanded position and a collapsed position.

11. The machine of claim 10, wherein the second member is nested within the first member when in the collapsed configuration.

12. The machine of claim 10, wherein the chute further comprises a positioner by which the position of second member is adjustable between the operative and collapsed positions.

13. The machine of claim 12, wherein the positioner comprises a cam member and an actuator, which is operated to move the cam member between the expanded and collapsed positions.

14. An optical sorting or classifying machine for sorting or classifying product, comprising a housing which includes an internal region, a chute which has a guide surface and is supported by the housing, an illumination unit for illuminating product as delivered on and/or from the chute, and at least one detector for detecting product as delivered on and/or from the the chute; wherein the chute is pivotably coupled to the housing about a first pivot between a first, operative configuration, and a second, stowed configuration, in which an operator can access or enter the internal region.

15. An optical sorting or classifying machine for sorting or classifying product, comprising a housing, and a chute which has a guide surface and is supported by the housing, an illumination unit for illuminating product as delivered on and/or from the chute, and at least one detector for detecting product as delivered on and/or from the chute; wherein the chute comprises a first member which is pivotally coupled to the housing about a first pivot, and a second member which supports the guide surface and is pivotally coupled to the first member about a second pivot between an operative, expanded position and a collapsed position.

* * * * *